US011180339B2

(12) United States Patent
Yamamoto et al.

(10) Patent No.: US 11,180,339 B2
(45) Date of Patent: Nov. 23, 2021

(54) KNIFE-TYPE FOLDING MACHINE

(71) Applicant: Horizon International Inc., Shiga (JP)

(72) Inventors: Hiroki Yamamoto, Shiga (JP); Yoshikazu Nakamura, Shiga (JP); Shigeru Wakimoto, Shiga (JP); Hideaki Tabuchi, Shiga (JP)

(73) Assignee: Horizon International Inc., Shiga (JP)

( * ) Notice: Subject to any disclaimer, the term of this patent is extended or adjusted under 35 U.S.C. 154(b) by 158 days.

(21) Appl. No.: 16/658,205

(22) Filed: Oct. 21, 2019

(65) Prior Publication Data

US 2020/0130981 A1 Apr. 30, 2020

(30) Foreign Application Priority Data

Oct. 29, 2018 (JP) ..... JP2018-202498

(51) Int. Cl.
*B65H 45/18* (2006.01)
*B65H 9/06* (2006.01)
*B65H 45/16* (2006.01)

(52) U.S. Cl.
CPC ..... *B65H 45/18* (2013.01); *B65H 9/06* (2013.01); *B65H 45/16* (2013.01); *B65H 2513/11* (2013.01)

(58) Field of Classification Search
None
See application file for complete search history.

(56) References Cited

U.S. PATENT DOCUMENTS 5,628,718 A * 5/1997 Huober ..... B65H 45/18 493/23
6,074,332 A * 6/2000 Helmstadter ..... B65H 45/18 493/254
7,022,059 B2 * 4/2006 Kitai ..... B65H 45/18 493/434
7,534,201 B2 * 5/2009 Yamamoto ..... B65H 9/06 493/419
9,126,798 B2 * 9/2015 Yamamoto ..... B65H 45/18
2007/0232474 A1 10/2007 Yamamoto

FOREIGN PATENT DOCUMENTS

| | | | |
|---|---|---|---|
| DE | 29904757 | U1 | 6/1999 |
| DE | 19931768 | A1 | 1/2001 |
| EP | 1251095 | A2 | 10/2002 |
| EP | 1900668 | A2 | 3/2008 |
| JP | 2007261726 | | 10/2007 |
| WO | 2011086700 | | 7/2011 |

OTHER PUBLICATIONS

European Search Report, in corresponding Application 19205900.4-1017, dated Mar. 24, 2020 (Mar. 24, 2020).

* cited by examiner

*Primary Examiner* — Leslie A Nicholson, III

(74) *Attorney, Agent, or Firm* — Kirschstein, Israel, Schiffmiller & Pieroni, P.C.

(57) ABSTRACT

A conveying unit 2including conveyor belts 7, a stopper 3positioning a sheet S at a folding position P on a conveying path 2, a knife-type folding unit 4, an anti-bounce roller unit 16having rollers 25*a*, 25*b*, and a motor 22 are provided. The rollers can be moved back and forth. A roller rotational speed monitoring unit 31 and a roller position setting unit 32 operatively connected to the motor are further provided. In setting mode, the rollers are moved from an upstream or a downstream of a tail end of the sheet positioned at the folding position P toward the tail end at a constant speed and stopped when the rotational speed of the rollers changes.

4 Claims, 3 Drawing Sheets

KNIFE-TYPE FOLDING MACHINE

TECHNICAL FIELD

The present invention relates to a knife-type folding machine in which a sheet is folded by a knife blade.

BACKGROUND ART

A conventional knife-type folding machine has a frame provided with a conveying path of a sheet (The technical term "sheet" means a signature as well as a sheet of paper.), a conveying unit attached to the frame so as to convey the sheet along the conveying path, and a stopper attached to the frame and extending across the conveying path at a right angle in such a way that the sheet is positioned at a predetermined folding position on the conveying path by coming into contact with the stopper at a leading end thereof (see, for example, JP 2007-261726 A and WO 2011/086700 A1).

The conveying unit consists of a pair of a drive roller and an idle roller which are attached to the frame and extend perpendicularly to a conveying direction at upstream and downstream ends of the conveying path, a conveyor belt extended between the drive roller and the idle roller, and a motor circulating the conveyor belt. A transport surface of the conveyor belt is positioned in the conveying path.

A pair of side guides are attached to the stopper and extended in a conveying direction on both sides of the folding position. One of the pair of side guides acts as a reference guide for positioning the sheet in a direction perpendicular to the conveying direction, while the other of the pair of side guides is elastically biased by a spring and positions the sheet in a direction perpendicular to the conveying direction at the folding position by pushing one side of the sheet entering the folding position toward the one of the pair of side guides so as to contact the other side of the sheet with the one of the pair of side guides.

The knife-type folding machine also has a pair of folding rollers attached to the frame and extending along the conveying path under the folding position, and a knife blade extending parallel with the pair of folding rollers and opposed to a gap of the pair of folding rollers above the pair of folding rollers.

Furthermore, the conveying path is provided with an opening through which the knife blade can pass in a vertical direction, and a slider crank mechanism is attached to the frame so as to reciprocate the knife blade in a vertical direction between a first position in which the knife blade is arranged above the folding position and a second position in which the knife blade comes close to the gap of the pair od folding rollers under the folding position.

Thus each time the sheet is positioned at the folding position, a crank of the slider crank mechanism makes a turn, and during the one turn of the crank, the knife blade fixed to one end of a rod which is connected to the crank performs a reciprocating motion in which the knife blade moves downward from the first position to the second position and moves upward from the second position to the first position. When the knife blade moves downward from the first position to the second position, the sheet passes through the opening of the conveying path while being folded in two by the knife blade and is inserted between the pair of folding rollers, and then the sheet is folded in two by the pair of folding rollers while the knife blade moves upward from the second position to the first position.

It is possible to increase productivity in this knife-type folding machine by conveying the sheet to the folding position at high speed and matching timing of folding of the knife blade with the conveying speed, but as the conveying speed increases, the sheet becomes difficult to stop exactly at the folding position because of bounce of the sheet from the stopper.

Therefore, some of conventional knife-type folding machines have an anti-bounce roller unit arranged at an upstream end of the folding position to prevent bounce of the sheet from the stopper.

The anti-bounce roller unit includes a roller support arranged above the folding position, at least one slide guide extending in the conveying direction above the conveying path, the roller support being slidably attached to the at least one slide guide, a support drive mechanism sliding the roller support back and forth, and at least one roller attached to the roller support so as to rotate around a horizontal axis extending at a right angle to the conveying direction while being pressed against the conveyor belt of the conveying unit.

A position of the at least one roller is set by hand before operation of the knife-type folding machine. In this case, when the at least one roller strongly contacts with a tail end of the sheet abutting on the stopper, the pair of side guides stops working and resistance is created at insertion of the sheet into the pair of folding rollers by the knife blade, which causes inclination of the sheet to the stopper.

On the other hand, when the at least one roller is located away from the tail end of the sheet abutted on the stopper, no bounce prevention effect is obtained.

Consequently, an operator sets the at least one roller in a manner such that an outer surface of the at least one roller adequately contacts with the tail end of the sheet positioned at the folding position by repeating fine adjustment of the position of the at least one roller while visually checking the contact condition between the outer surface of the at least one roller and the tail end of the sheet abutted on the stopper.

However, this setting work of the at least one roller of the anti-bounce roller unit takes much time, which contributes to the decrease in work efficiency.

Furthermore, recently, there are some knife-type folding machines capable of automatically setting the position of a roller or rollers of an anti-bounce roller unit based on length information of a sheet and setting position information of a stopper, but even if the sheet length is the same, a position at which the roller or rollers adequately contact with a tail end of the sheet fluctuates according to thickness of the sheet (in a signature, the number of stacked sheets).

For this reason, when higher accuracy is required, the position of the roller or the rollers of the anti-bounce roller unit automatically set should be fine-adjusted by an operator so that work efficiency decreases as above.

SUMMARY OF THE INVENTION

Problems to be Solved by the Invention

It is, therefore, an object of the present invention to provide a knife-type folding machine facilitating rapid setting of a roller or rollers of an anti-bounce roller unit.

Means for Solving the Problems

In order to achieve this object, the present invention provides a knife-type folding machine comprising: a conveying unit conveying a sheet along a conveying path; a stopper extending across the conveying path at a right angle, the sheet being positioned at a predetermined folding position on the conveying path by coming into contact with the stopper at leading end thereof; a knife-type folding unit folding the sheet positioned at the folding position in a conveying direction; and an anti-bounce roller unit arranged at an upstream end of the folding position to prevent bounce of the sheet from the stopper, wherein the conveying unit includes a pair of drive and idle rollers which are arranged at upstream and downstream ends of the conveying path, a plurality of conveyor belts extended between the pair of drive and idle rollers, conveying surfaces of the plurality of conveyor belts forming the conveying path, and a roller drive mechanism rotating the drive roller, wherein the anti-bounce roller unit includes a roller support arranged above the folding position, at least one slide guide extending in the conveying direction above the conveying path, the roller support being slidably attached to the at least one slide guide, a support drive mechanism sliding the roller support back and forth, and at least one roller attached to the roller support so as to rotate around a horizontal axis extending at a right angle to the conveying direction while being pressed against the plurality of conveyor belts of the conveying unit, the sheet entering the folding position while passing through the at least one roller and the plurality of conveyor belts, an outer surface of the at least one roller contacting with a tail end of the sheet when the sheet abuts on the stopper, characterized in that the knife-type folding machine can switch operation between a normal operation mode and a setting mode, and, in the setting mode, the plurality of conveyor belts of the conveying unit are continuously rotated at a constant speed so that the sheet is conveyed to the folding position and positioned at the folding position while the knife-type folding unit is kept on a standby state, wherein the knife-type folding machine further comprises a sensor detecting a rotational speed of the at least one roller of the anti-bounce roller unit, a roller rotational speed monitoring unit receiving a detection signal from the sensor and sending an appropriate position arrival signal in the setting mode when the rotational speed of the at least one roller starts to change, and a roller position setting unit operatively connected to the support drive mechanism of the anti-bounce roller unit and activating the support drive mechanism in the setting mode so as to move the at least one roller from an upstream or a downstream of a tail end of the sheet positioned at the folding position toward the tail end at a constant speed and stopping the support drive mechanism when the roller position setting unit receives the appropriate position arrival signal.

Here, the technical term "sheet" means a signature as well as a sheet of paper (the same applies hereafter).

According to a preferred embodiment of the present invention, the sensor has a plurality of elements to be detected fixed to one end face of the at least one roller in such a way that the elements to be detected are arranged at a constant angular pitch along a circumference around a rotation axis of the at least one roller, and a proximity sensor fixed to the roller support in such a way that the proximity sensor faces the elements to be detected and detecting the elements to be detected.

According to another preferred embodiment of the present invention, the sensor has a disc to be detected fixed concentrically to one end face of the at least one roller, a plurality of through holes being formed on the disc to be detected at a constant angular pitch along a circumference of the disc to be detected, and a pair of photoelectric elements attached to the roller support in such a way that the photoelectric elements are arranged opposite each other across the through holes.

According to further preferred embodiment of the present invention, the sensor is a rotary encoder or a potentiometer attached to the rotation axis of the at least one roller of the anti-bounce roller unit.

Effect of the Invention

According to the present invention, in the setting mode of the knife-type folding machine, the plurality of conveyor bells of the conveying unit are continuously rotated at a constant speed so that a sheet is conveyed to the folding position and positioned at the folding position while the knife-type folding unit is kept on the standby state. Further, the at least one roller of the anti-bounce roller unit is moved from an upstream or a downstream of a tail end of the sheet positioned at the folding position toward the tail end at a constant speed, and a rotational speed of the at least one roller is monitored while the at least one roller is moved, and the at least one roller is stopped moving when the rotational speed of the at least one roller starts to change. At this stop position, an outer surface of the at least one roller contacts adequately with the tail end of the sheet positioned at the folding position.

Thus the setting of the roller(s) of the anti-bounce roller unit is carried out automatically so that work efficiency greatly improved.

BEST MODE FOR CARRYING OUT THE INVENTION

A preferred embodiment of the present invention will be explained below with reference to accompanying drawings.

Figure 1:
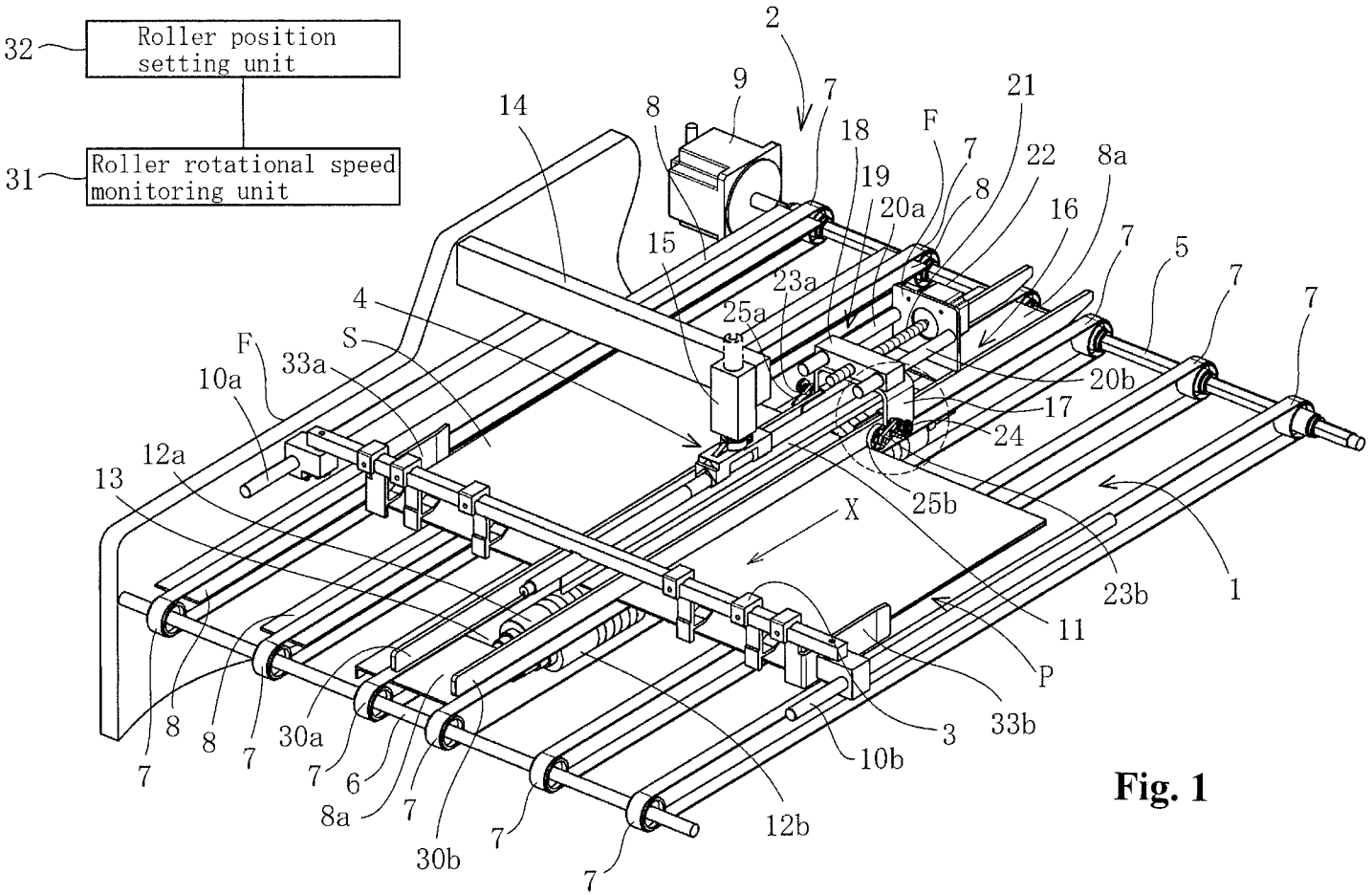
FIG. 1 is a perspective view of a knife-type folding machine according to an embodiment of the present invention, in which the knife-type folding machine operates in setting mode.

FIG. 1 is a perspective view of a knife-type folding machine according to an embodiment of the present invention, in which the knife-type folding machine operates in setting mode.

Referring to FIG. 1, a knife-type folding machine according to the present invention comprises a conveying unit 2 conveying a sheet S along a conveying path 1, and a stopper 3 extending across the conveying path 1 at a right angle. The sheet S is positioned at a predetermined folding position P on the conveying path 1 by coming into contact with the stopper 3 at a leading end thereof.

The knife-type folding machine also comprises a knife-type folding unit 4 folding the sheet S positioned at the folding position P in a conveying direction (indicated by an arrow X).

The conveying unit 2 has a pair of drive and idle rollers 5 and 6 attached to a frame F at upstream and down stream ends of the conveying path 1 and extending at a right angle to the conveying direction (arrow X), and a plurality of conveyor belts 7 extended between the drive and idle rollers 5 and 6. Conveying surfaces of the conveyor belts 7 form the conveying path 1.

A plurality of elongate support plates 8 and 8*a* (only some of the support plates are shown in the drawings) are attached on the frame F under the conveyor belts 7 so as to support the underside of the conveying surfaces of the conveyor belts 7 and extended along the conveying path 1.

The conveying unit 2 further has a motor (roller drive mechanism) 9 attached to the frame F so as to rotate the drive roller 5.

The drive roller 5 is rotated by the motor 9 and thereby the conveyor belts 7 are circulated, so that the sheet S is conveyed along the conveying path 1.

The stopper 3 slidably attached to a pair of slide guides 10*a*, 10*b* fixed to the frame F on both sides of the conveying path 1 and extended in the conveying direction (arrow X). The stopper 3 can be fixed at a desired position on the slide guides 10*a*, 10*b* and thereby, a position of the stopper 3 can be adjusted in the conveying direction (arrow X).

A pair of side guides 33*a*, 33*b* is attached to the stopper 3 and extended in the conveying direction (arrow X) on both sides of the folding position P.

One side guide 33*a* of the pair of side guides 33*a*, 33*b* functions as a reference guide for positioning the sheet S in a direction perpendicular to the conveying direction (arrow X), while the other side guide 33*b* of the pair of side guides 33*a*, 33*b* is elastically biased by a spring (not shown) and pushes one side of the sheet S entering the folding position P toward the side guide 33*a* in such a manner that the sheet S contacts with the side guide 33*a* at the other side thereof so as to be positioned in a direction perpendicular to the conveying direction (arrow X) at the folding position.

The pair of side guides 33*a*, 33*b* can be independently moved in a direction perpendicular to the conveying direction (arrow X) by a drive mechanism (not shown) and therefore, the position of these side guides 33*a*, 33*b* can be adjusted automatically according to the size of the sheet S.

The knife-type folding unit 4 has a knife blade 11 and a pair of folding rollers 12*a*, 12*b* which face each other in a vertical direction across the conveying path 1.

The pair of folding rollers 12*a*, 12*b* is attached to the frame F and extended in the conveying direction (arrow X) under the conveying path 1 (a central support plate 8*a*), and the knife blade 11 extends parallel with the pair of folding rollers 12*a*, 12*b* and is arranged opposite to a gap between the pair of folding rollers 12*a*, 12*b* above the pair of folding rollers 12*a*, 12*b*. The support plate 8*a* is provided with an opening 13 through which the knife blade 11 can pass in a vertical direction.

The knife-type folding unit 4 also has a knife drive mechanism 15 attached to the frame F through a support arm 14 so as to reciprocate the knife blade 11 in a vertical direction between a first position in which the knife blade 11 is arranged above the conveying path 1 and a second position in which the knife blade 11 comes close to the gap between the pair of folding rollers 12*a*, 12*b* under the conveying path 1.

Thus each time the sheet S is positioned at the folding position P, the knife blade 11 reciprocates in a manner such that the knife blade 11 returns from the first position to the first position via the second position.

During this reciprocation, when the knife blade 11 moves downward from the first position to the second position, the sheet S is inserted between the pair of folding rollers 12*a*, 12*b* through the opening 13 while being folded in two by the knife blade 11, and then the sheet S is folded by the pair of folding rollers 12*a*, 12*b* when the knife blade 11 moves upward from the second position to the first position.

In this embodiment, the knife-type folding machine further comprises an anti-bounce roller unit 16 arranged at an upstream end of the folding position P to prevent bounce of the sheet S from the stopper 3.

The anti-bounce roller unit 16 includes an inverted U-shaped bracket 1 extending across the opening 13 above the folding position P, and a roller support 19 composed of a rectangular block 18 fixed on an upper surface of the bracket 17.

The block 18 has through holes extending in the conveying direction (arrow X) on both sides thereof and a screw hole passing through the block in the conveying direction (arrow X) at the center thereof.

The anti-bounce roller unit 16 also includes a pair of slide guides 20*a*, 20*b* extending in the conveying direction (arrow X) above the conveying path 1 and inserted through the through holes, and a threaded shaft 21 extending in the conveying direction (arrow X) and supported by the frame F so as to be rotatable around an axis thereof at a fixed position. The threaded shaft 21 is screwed into the screw hole of the block 18 at one end thereof. The anti-bounce roller unit 16 further includes a motor 22 fixed to the frame F. A drive shaft of the motor 22 is connected directly to the other end of the threaded shaft 21.

The threaded shaft 21 and the motor 22 configure a support drive mechanism. A position of the roller support 19 can be adjusted in the conveying direction (arrow X) by the threaded shaft 21 being rotated by the motor 22 forward and reverse.

Figure 2B:
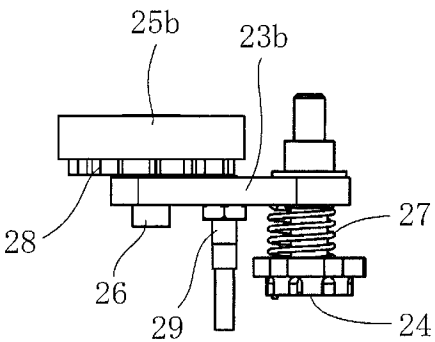
FIG. 2B is a plan view illustrating a configuration near a roller of an anti-bounce roller unit shown in FIG. 1.
Figure 2C:
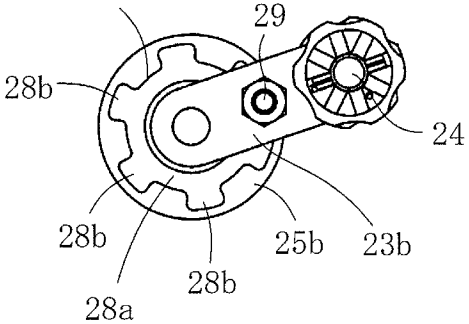
FIG. 2C is a side view illustrating a configuration near the roller of the anti-bounce roller unit shown in FIG. 1.
Figure 2A:
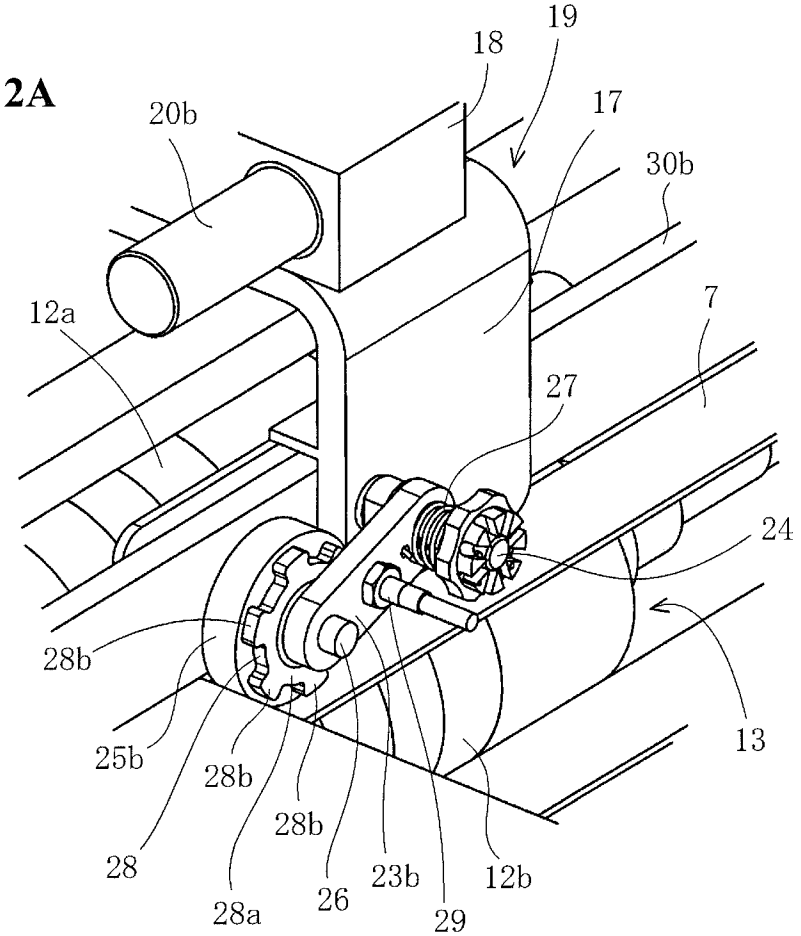
FIG. 2A is an enlarged perspective view of a region surrounded by a circle in FIG. 1.

FIG. 2A is an enlarged perspective view of a region surrounded by a circle in FIG. 1, and FIG. 2B is a plan view illustrating a configuration near a roller of the anti-bounce roller unit shown in FIG. 1 and FIG. 2C is a side view illustrating a configuration near the roller of the anti-bounce roller unit shown in FIG. 1.

Referring to FIG. 2, the bracket 17 has a pair of levers 23*a*, 23*b* at exterior surfaces of both sides thereof. Each of the levers 23*a*, 23*b* is attached to the bracket 17 by screws 24 so as to be rotatable around one end thereof. A roller 25*a*, 25*b* is attached to the other end of each of the levers 23*a*, 23*b* so as to be rotatable around a horizontal axis 26 extending at a right angle to the conveying direction (arrow X) on the associated conveyor belt 7.

A torsion spring 27 is arranged between the screw 24 and the lever 23*a*, 23*b* so as to elastically bias the lever 23*a*, 23*b* in a direction that the roller 25*a*, 25*b* is pressed against the conveyor belt 7.

In this case, the strength of pressure of roller 25*a*, 25*b* against the conveyor belt 7 can be adjusted by adjustment of tightening force of the screw 24.

Furthermore, a disc 28 to be detected is fixed concentrically to an end face of one roller 25*b* of the rollers 25*a*, 25*b* which faces the associated lever 23*b*. The disc 28 to be detected is composed of a disc-shaped body 28*a*, and a plurality of protrusions 28*b* formed at regular intervals on an outer periphery of the disc-shaped body 28*a*.

On the other hand, a proximity sensor 29 is fixed on a surface of the lever 23*b* which faces the disc 28 to be detected and corresponds to the protrusions 28*b* so as to detect the protrusions 28*b*.

Thus when the roller 25*b* rotates, the protrusions 28*b* of the disc 28 to be detected are sequentially detected by the proximity sensor 29 and a detection signal as pulse signals is output from the proximity sensor 29, and a rotational speed of the roller 25*b* can be detected by monitoring these pulse signals.

A pair of guide plates 30*a*, 30*b* is attached to the frame F and extends in the conveying direction (arrow X) on both sides of the opening 13 above the conveying path 1. The sheet S is conveyed to the folding position P while passing through a gap between the conveying path 1 and lower ends of the guide plates 30*a*, 30*b*.

The knife-type folding machine can switch operation between a normal operation mode and a setting mode.

In the setting mode, the plurality of conveyor belts 7 of the conveying unit 2 are continuously rotated at a constant speed so that the sheet S is conveyed to the folding position P and positioned at the folding position P while the knife-type folding unit 4 is kept on a standby state in which the knife blade 11 remains in the first position).

The knife-type folding machine further comprises a roller rotational speed monitoring unit 31 receiving the detection signal from the proximity sensor 29 and sending an appropriate position arrival signal when the rotational speed of the roller 25*b* starts to change in the setting mode, and a roller position setting unit 32 operatively connected to the motor 22 of the anti-bounce roller unit 16 and activating the motor 22 (and the threaded shaft 21) in the setting mode so as to move the roller 25*b* from an upstream or a downstream of a tail end of the sheet S positioned at the folding position P toward the tail end at a constant speed and stopping the motor 22 (and the threaded shaft 21) when the roller position setting unit 32 receives the appropriate position arrival signal.

Next, an operation of the roller rotational speed monitoring unit 31 and the roller position setting unit 32 will be explained in detail.

FIGS. 3A through 3D are side views illustrating a method of position setting of the roller 25*b* of the anti-bounce roller unit 16 of the knife-type folding machine of the present invention during operation in the setting mode.

Figure 3A:
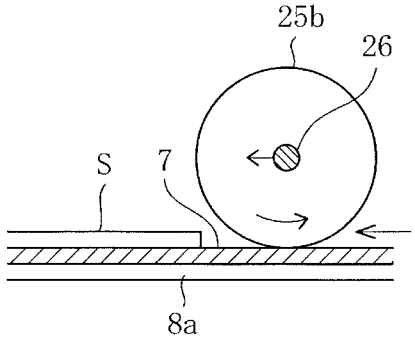
FIGS. 3A through 3D are side views illustrating a method of position setting of the roller of the anti-bounce roller unit of the knife-type folding machine shown in FIG. 1 during operation in the setting mode.
Figure 3B:
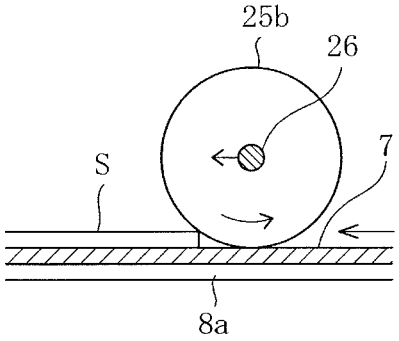

Referring to FIGS. 3A and 3B, in the setting mode, the roller position setting unit 32 activates the motor 22 (and the threaded shaft 21) so as to move the roller 25*b* from an upstream of a tail end of the sheet S positioned at the folding position P (see, FIG. 3) toward the tail end at a constant speed.

From the time the roller 25*b* starts moving until the roller 25*b* contacts with the tail end of the sheet S, the roller 25*b* contacts with the conveyor belt 7 rotated at a constant speed so that the roller 25*b* rotates at a constant rotational speed according to the difference between the movement speed of the roller 25*b* and the rotational speed of the conveyor belt 7. Consequently, during this time, the proximity sensor 29 outputs pulse signals (detection signal) with constant frequency.

As shown in FIG. 3B, when an outer surface of the roller 25*b* contacts with the tail end of the sheet S, the rotational speed of the roller 25*b* starts to slow down because resistance to the rotation of the roller 25*b* is generated. At this time, the frequency of the pulse signal output from the proximity sensor 29 changes and the roller rotational speed monitoring unit 31 sends the appropriate position arrival signal.

The appropriate position arrival signal is received by the roller position setting unit 32 and the roller position setting unit 32 stops the motor 22 (and threaded shaft 21).

At this time, the outer surface of the roller 25*b* contacts adequately with the tail end of the sheet S positioned at the folding position P.

Figure 3C:
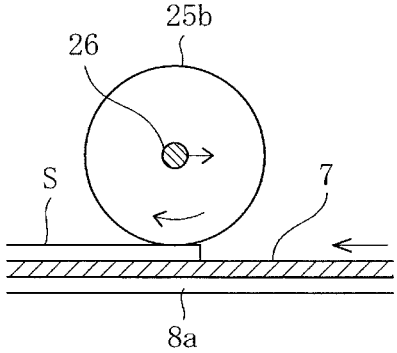
Figure 3D:
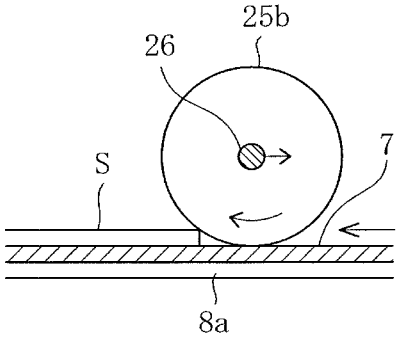

Alternatively, referring to FIGS. 3C and 3D, in the setting mode, the roller position setting unit 32 activates the motor 22 (and the threaded shaft 21) so as to move the roller 25*b* from a downstream of the tail end of the sheet S positioned at the folding position P (see, FIG. 3C) toward the tail end at a constant speed.

From the time the roller 25*b* starts moving until the roller 25*b* comes down on the conveyor belt 7, the roller 25*b* contacts with the sheet S which is at rest so that the roller 25*b* rotates at a constant rotational speed according to the movement speed of the roller 25*b*. Consequently, during this time, the proximity sensor 29 outputs pulse signals (detection signal) with constant frequency.

As shown in FIG. 3D, when the roller 25*b* comes down on the conveyor belt 7, the rotational speed of the roller 25*b* starts to rise because the rotational force of the roller 25*b* is increased by the rotational force of the conveyor belt 7. At this time, the frequency of the pulse signal output from the proximity sensor 29 changes and the roller rotational speed monitoring unit 31 sends the appropriate position arrival signal.

The appropriate position arrival signal is received by the roller position setting unit 32 and the roller position setting unit 32 stops the motor 22 (and threaded shaft 21).

At this time, the outer surface of the roller 25*b* contacts adequately with the tail end of the sheet S positioned at the folding position P.

After completing this setting of position of the roller 25*b* of the anti-bounce roller unit 16, the sheet S is accurately positioned by the stopper 3 and the pair of side guides 33*a*, 33*b* and does not tilt with respect to the stopper 3 when the sheet S is inserted between the pair of folding rollers 12*a*, 12*b* by the knife blade 11.

Thus, according to the present invention, the setting of the roller 25*b* of the anti-bounce roller unit 16 is carried out automatically so that work efficiency greatly improved.

While a preferred embodiment of the present invention has been set forth for purposes of illustration, the foregoing description should not be deemed a limitation of the invention herein. Accordingly, various modifications, adaptations and alternatives may occur to one skilled in the art without departing from the spirit and the scope of the present invention.

For example, although the sensor for detecting the rotational speed of the roller 25*b* of the anti-bounce roller unit 16 is composed of the disc 28 to be detected and the proximity sensor 29 in the above embodiment, the sensor for detecting the rotational speed of the roller 25*b* may comprise a disc to be detected fixed concentrically to one end face of the roller 25*b*, a plurality of through holes being formed on the disc to be detected at a constant angular pitch along a circumference of the disc to be detected, and a pair of photoelectric elements attached to the roller support in such a way that the photoelectric elements are arranged opposite each other across the through holes.

Also, the sensor for detecting the rotational speed of the roller 25*b* may be a rotary encoder or a potentiometer attached to the rotation axis of the roller 25*b*.

According to another embodiment, the roller rotational speed monitoring unit 31 comprises a display showing the rotational speed of the roller 25*b* and a button for transmitting the appropriate position arrival signal. Then an operator monitors changes in the rotational speed of the roller 25*b* while watching the display, and, when the rotational speed changes, he pushes the button so as to send the appropriate position arrival signal to the roller position setting unit 32.

In this embodiment, the setting of the roller 25*b* of the anti-bounce roller unit 16 is semi automated.

DESCRIPTION OF REFERENCE NUMERALS

1 Conveying path
2 Conveying unit
3 Stopper
4 Knife-type folding unit
5 Drive roller
6 Idle roller
7 Conveyor belt
8, 8*a* Support plate
9 Motor
10*a*, 10*b* Slide guide
11 Knife blade
12*a*, 12*b* Folding roller
13 Opening
14 Support arm
15 Knife drive mechanism
16 Anti-bounce roller unit
17 Bracket
18 Block
19 Roller support
20*a*, 20*b* Slide guide
21 Threaded shaft
22 Motor
23*a*, 23*b* Lever
24 Screw
25*a*, 25*b* Roller
26 Horizontal axis
27 Torsion spring
28 Disc to be detected
28*a* Disc-shaped body
28*b* Protrusion
29 Proximity sensor
30*a*, 30*b* Guide plate
31 Roller rotational speed monitoring unit
32 Roller position setting unit
33*a*, 33*b* Side guide
F Frame
P Folding position
S Sheet
X Conveying direction

The invention claimed is:

1. A knife-type folding machine comprising:

a conveying unit conveying a sheet along a conveying path;

a stopper extending across the conveying path at a right angle, the sheet being positioned at a predetermined folding position on the conveying path by corning into contact with the stopper at a leading end thereof;

a knife-type folding unit folding the sheet positioned at the folding position in a conveying direction; and an anti-bounce roller unit arranged at an upstream end of the folding position to prevent bounce of the sheet from the stopper, wherein the conveying unit includes a pair of drive and idle rollers which are arranged at upstream and downstream ends of the conveying path, a plurality of conveyor belts extended between the pair of drive and idle rollers, conveying surfaces of the plurality of conveyor belts forming the conveying path, and a roller drive mechanism rotating the drive roller, wherein the anti-bounce roller unit includes a roller support arranged above the folding position, at least one slide guide extending in the conveying direction above the conveying path, the roller support being slidably attached to the at least one slide guide, a support drive mechanism sliding the roller support back and forth, and at least one roller attached to the roller support so as to rotate around a horizontal axis extending at a right angle to the conveying direction while being pressed against the plurality of conveyor belts of the conveying unit, the sheet entering the folding position while passing through the at least one roller and the plurality of conveyor belts, an outer surface of the at least one roller contacting with a tail end of the sheet when the sheet abuts on the stopper, characterized in that the knife-type folding machine can switch operation between a normal operation mode and a setting mode, and, in the setting mode, the plurality of conveyor belts of the conveying unit are continuously rotated at a constant speed so that the sheet is conveyed to the folding position and positioned at the folding position while the knife-type folding unit is kept on a standby state, wherein the knife-type folding machine further comprises a sensor detecting a rotational speed of the at least one roller of the anti-bounce roller unit, a roller rotational speed monitoring unit receiving a detection signal from the sensor and sending an appropriate position arrival signal in the setting mode when the rotational speed of the at least one roller starts to change, and a roller position setting unit operatively connected to the support drive mechanism of the anti-bounce roller unit and activating the support drive mechanism in the setting mode so as to move the at least one roller from an upstream or a downstream of a tail end of the sheet positioned at the folding position toward the tail end at a constant speed and stopping the support drive mechanism when the roller position setting unit receives the appropriate position arrival signal.

2. The knife-type folding machine according to claim 1, wherein the sensor has a plurality of elements to be detected fixed to one end face of the at least one roller in such a way that the elements to be detected are arranged at a constant angular pitch along a circumference around a rotation axis of the at least one roller, and a proximity sensor fixed to the roller support in such a way that the proximity sensor faces the elements to be detected and detecting the elements to be detected.

3. A knife-type folding machine comprising:

a conveying unit conveying a sheet along a conveying direction;

a stopper extending across the conveying direction at a right angle, the sheet being positioned at a predetermined folding position in the conveying direction by coming into contact with the stopper at leading end thereof;

a knife-type folding unit folding the sheet positioned at the folding position in the conveying direction; and an anti-bounce roller unit configured to prevent bounce of the sheet from the stopper, wherein the anti-bounce roller unit includes at least one anti-bounce roller configured to rotate around a horizontal axis extending at a right angle to the conveying direction while being pressed against the conveying unit, a drive mechanism configured to adjust a position of the anti-bounce roller in the conveying direction, and a roller position setting unit configured to operate the drive mechanism so as to move the anti-bounce roller from an upstream of a tail end of the sheet positioned at the folding position in the conveying direction toward the tail end of the sheet and so as to stop the anti-bounce roller in a case where the anti-bounce roller contacts with the tail end of the sheet.

4. The knife-type folding machine according to claim 3, wherein the anti-bounce roller unit further includes a sensor configured to detect a rotational speed of the anti-bounce roller, wherein the roller position setting unit is configured to operate the drive mechanism so as to stop the anti-bounce roller in a case where the sensor sends a signal indicating that the rotational speed of the anti-bounce roller starts to slow down.

* * * * *